US009927170B2

(12) United States Patent
Kerber et al.

(10) Patent No.: US 9,927,170 B2
(45) Date of Patent: Mar. 27, 2018

(54) HEAT EXCHANGER SYSTEM

(75) Inventors: Christiane Kerber, Pocking (DE); Jurgen Spreemann, Rosenheim (DE); Norbert Reiter, Trostberg (DE); Markus Hammerdinger, Tacherting (DE); Manfred Steinbauer, Raisting (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 1493 days.

(21) Appl. No.: 13/433,802

(22) Filed: Mar. 29, 2012

(65) Prior Publication Data

US 2012/0247147 A1 Oct. 4, 2012

(30) Foreign Application Priority Data

Mar. 29, 2011 (DE) ..... 10 2011 015 433

(51) Int. Cl.
*F25J 1/00* (2006.01)
*F25J 1/02* (2006.01)

(52) U.S. Cl.
CPC ..... *F25J 1/0022* (2013.01); *F25J 1/0055* (2013.01); *F25J 1/0092* (2013.01); *F25J 1/0212* (2013.01); *F25J 1/0258* (2013.01); *F25J 1/0262* (2013.01); *F25J 2220/64* (2013.01)

(58) Field of Classification Search
CPC ..... F25J 1/0204; F25J 1/0205; F25J 1/0207; F25J 1/0208; F25J 1/0209; F25J 1/0211; F25J 1/0212; F25J 1/0214; F25J 1/0215; F25J 1/0216; F25J 1/0217; F25J 1/0218; F25J 1/0219; F25J 1/0262; F25J 1/0263; F25J 1/022; F25J 1/0055; F25J 1/0258
USPC ..... 62/611, 612, 614, 616
See application file for complete search history.

(56) References Cited

U.S. PATENT DOCUMENTS 3,364,685 A * 1/1968 Perret ..... F16J 15/26 62/114
3,578,073 A * 5/1971 Bosquain ..... 165/111
3,593,535 A * 7/1971 Gaumer et al. ..... 62/612
3,780,535 A * 12/1973 Darredeau ..... F25B 9/10 62/612
3,855,810 A * 12/1974 Simon et al. ..... 62/612
(Continued)

FOREIGN PATENT DOCUMENTS

DE 198 48 280 A1 4/2000
EP 1323994 A2 * 7/2003

*Primary Examiner* — John F Pettitt
(74) *Attorney, Agent, or Firm* — Millen White Zelano & Branigan, PC

(57) ABSTRACT

The invention relates to a heat exchanger system (1) for heat exchange between at least a first medium (M), in particular in the form of a hydrocarbon-rich phase, and a second medium (K), with at least first and second pipe space sections (101, 103; 103, 105) for accommodating the first medium (M), and with a first pipe space section connecting means (102; 104), via which the two pipe space sections (101, 103; 103, 105) are connected to one another in a flow-guiding manner. The first pipe space section (101; 103) is surrounded by a first shell space (201, 203), and the second pipe space section (103; 105) is surrounded by a second shell space (203, 205) for accommodating the second medium (K). The first shell space (201; 203) is defined by a first shell (301; 303) and the second shell space (203; 205) is defined by a second shell (303; 305).

14 Claims, 6 Drawing Sheets

(56) References Cited

U.S. PATENT DOCUMENTS

| | | | | |
|---|---|---|---|---|
| 4,229,195 | A * | 10/1980 | Forg | 62/612 |
| 4,865,124 | A * | 9/1989 | Dempsey | F28D 7/024 165/160 |
| 6,347,532 | B1 * | 2/2002 | Agrawal | F25J 1/0214 62/612 |
| 6,877,552 | B1 * | 4/2005 | King | F28D 7/024 165/159 |
| 2006/0086140 | A1 * | 4/2006 | Eaton | F25J 1/0022 62/612 |
| 2007/0175240 | A1 * | 8/2007 | Jager | F25J 1/0022 62/612 |
| 2010/0132405 | A1 * | 6/2010 | Nilsen | 62/611 |

* cited by examiner

HEAT EXCHANGER SYSTEM

SUMMARY OF THE INVENTION

The invention relates to a heat exchanger system for providing heat exchange between at least a first medium, in particular in the form of a hydrocarbon-rich phase, and a second medium.

Such a heat exchanger system used in the heat exchange between at least one first medium, in particular in the form of a hydrocarbon-rich phase, and a second medium (e.g., refrigerant mixture), can include at least two first pipe space sections for accommodating the first medium. These two first pipe space sections can be connected to one another in a flow-guiding manner via a first pipe space section connecting means, in particular in the form of at least one pipeline. Such a heat exchanger system is known from, e.g., DE 198 48 280 A1.

Such heat exchanger systems can be equipped, e.g., for liquefaction of a hydrocarbon-rich phase (natural gas) that is fed in gaseous form into the heat exchanger system. In the above-mentioned existing apparatus design, three heat exchanger bundles (pre-cooler, liquefier and subcooler) are arranged above one another in a common pressurized shell, which can be suspended in, e.g., a steel frame. Because of deficient or inadequate infrastructure, shipping such a heat exchanger system is made very difficult. In addition, a widening of the shell is provided, in an especially uniform way for such systems, so that there is enough space between the shell and the pipes (or tube bundle) so that a regular separation of gas and liquid can occur. This widening of the shell also results in elevated costs, supply times and container sizes.

An aspect of this invention is therefore to provide a heat exchanger system of the above-mentioned type, in which the shipping and handling are improved with the design.

Upon further study of the specification and appended claims, other aspects and advantages of the invention will become apparent.

In accordance with the invention, there is provided a heat exchanger system of the type described above in which the one first pipe space section is surrounded by a first shell space, and the other first pipe space section is surrounded by a second shell space for accommodating the second medium. The first shell space is defined by a first shell and the second shell space is defined by a second shell that is separately designed for that purpose.

Accordingly, it is provided that the one first pipe space section is surrounded by a first shell space and the other first pipe space section is surrounded by a second shell space for accommodating the second medium, whereby the two shell spaces in each case are surrounded by a shell, which are designed separately from one another, thus, e.g., separated from one another or arranged at some distance from one another. The pipe space section connecting means is thus arranged at least in certain sections outside of the two shells and bridges in particular a distance between the two shells (this also applies for the additional pipe space section connecting means, which connect the pipe space sections of separate shells to one another). Such separate shells are designed in particular in a pressurized form and in each case have a circumferential wall, a cover, and a base. The circumferential wall extends along the longitudinal axis of the shell between the cover and the base. The cover and the base each extend crosswise to the longitudinal axis of the shell. Covers and bases can be designed curved, in particular cap-shaped. In addition, in principle, even more than two separate shells, e.g., three or four separate shells, can be provided, which can be arranged above one another and/or at some distance from one another. A pipe space section connecting means can be formed by, e.g., two connecting pipes, that are connected via a pipeline, which are formed onto assigned (separate) shells. The pipeline can be connected via, e.g., flanged connections to the supports.

In addition, the second shell—relative to a state of the heat exchanger system that is arranged as directed—is arranged along the vertical above or at some distance from the first shell. In this case, the two shells (or even more than two shells) preferably are arranged coaxially relative to one another (that is, relative to their respective longitudinal or cylinder axis).

The separation of the shell spaces or shells has, on the one hand, the advantage that shipping is considerably facilitated by the separate devices, and the expensive welding that is required when assembling one-piece shells at the construction site is unnecessary. On the other hand, finished components can be delivered to the customer by the division of the devices, the components that can be connected to one another, for example, by comparatively more economical standard tubing. Defect-influencing variables, such as, e.g., weld defects, component damage, fouling and logistics are thus minimized. Also, expansions can be made considerably more easily on shells of multiple-shell heat exchanger systems than on circumferential walls of heat exchanger systems, which have several pipe bundles that are arranged above one another in a uniform shell.

The two shell spaces or the corresponding shells are preferably connected to one another in a flow-guiding manner by a first shell space connecting means, in particular in the form of at least one pipeline, in such a way that the second medium can flow from one shell space into the other shell space. Such a shell space connecting means (e.g., supports that are connected to one another via pipelines, see above) can be built up by means of a standard piping, which correspondingly lowers the production costs.

In addition, the shell space connecting means can be equipped and provided therein for the purpose of guiding a gaseous fraction of the second medium, separately from a liquid fraction of the second medium, from the second shell space into the first shell space. This separation simplifies the gas and liquid distribution in the shell or heat exchanger thereunder. In addition, it can be provided that the (upper, along the vertical) second shell has an expanded region (a widened region of the shell), e.g., on a lower section thereof (see FIG. 7). In this respect, the flow rate of a gaseous fraction of the second medium that flows downward into the shell space can be controlled (slowed down) to ensure the equal distribution between each fraction and a liquid fraction of the second medium in the (first) shell space thereunder (the expanded region can also be provided on another section of the shell if the corresponding slowing-down of a gaseous phase is to be performed there). As an alternative or in addition, the second shell can, for example, have a separating system (e.g., a simple separator that allows for collection of the liquid in the bottom thereof and the rising of gas to the top) (see FIG. 8) in a lower section of the second shell, which system is designed therein to separate the liquid fraction of the second medium that is guided in the second shell space from the corresponding gaseous fraction. An expanded region of the shell can optionally be eliminated by the installation of a "separator" or a separating mechanism in the form of a separating system in the respective shell below the pipe bundle or pipe space that is arranged therein.

According to the invention, at least two shells are separated from one another and in this case are arranged in particular above one another and/or at some distance from one another. In this connection, a first shell (and the pipe bundle arranged therein) is equipped and provided for the purpose of pre-cooling the first medium and the second shell arranged thereabove (and the pipe bundle arranged therein) is equipped and provided for the purpose of iquefying the first medium.

As an alternative to this, however, the first shell (and the pipe bundle arranged therein) can also be equipped and provided for the purpose of liquefying the first medium and the second shell arranged thereabove (and the pipe bundle arranged therein) for subcooling the first medium. In this case, within the first shell there is preferably provided a second pipe space section, which is surrounded by the first shell space and is designed therein to accommodate a gaseous fraction of the second medium, e.g., via a first inlet of the first shell. The second pipe space section of the first shell preferably runs along the first pipe space section of the first shell to make possible an indirect heat exchange between the media flowing through these pipe space sections. In addition, in this connection, the first shell is further preferably provided with a third pipe space section, which is surrounded by the first shell space and is designed to accommodate a liquid fraction of the second medium, e.g., via a second inlet of the first shell. This third pipe space section of the first shell runs in particular along the first pipe space section of the first shell to make possible an indirect heat exchange between the media flowing through these pipe space sections. In addition, in this embodiment, the third pipe space section of the first shell is preferably run at an upper end of the first shell to introduce a liquid fraction of the second medium (refrigerant) into the first shell space, which enters into indirect heat exchange with the media that are guided in the pipe space sections, in particular with the first medium that is accommodated in the first pipe space section, in such a way that the latter can be liquefied in the first shell. The second pipe space section of the first shell in addition is preferably connected in a flow-guiding manner via a second pipe space section connecting means, in particular in the form of at least one pipeline, to a second pipe space section of the second shell that is surrounded by the second shell. In this case, the second pipe space section runs along the first pipe space section of the second shell to make possible in turn an indirect heat exchange between the media flowing through these pipe space sections. Preferably, the second pipe space section of the second shell is connected at an upper end of the second shell to introduce a gaseous fraction of the second medium into the second shell space, in such a way that the latter can enter into indirect heat exchange with the media that are guided in the pipe space sections of the second shell to thereby achieve subcooling of the first medium.

In another embodiment of the invention, an additional (separate) third shell is provided, which is arranged preferably above the second shell and optionally at some distance from this second shell. The third shell contains an additional first pipe space section for accommodating the first medium (e.g., natural gas), which is connected in a flow-guiding manner via a second pipe space section connecting means, in particular in the form of at least one pipeline, to the first pipe space section of the second shell. The first and second shells are now used in particular for pre-cooling and liquefying the first medium, respectively. The third shell is, in particular, used for subcooling the first medium) In this case, the additional first pipe space section is surrounded by a related third shell space, defined by the third shell, for accommodating the second medium, which is designed separately from the first and second shells and shell spaces. The third shell is preferably arranged along the vertical above or at some distance from the second shell (and first shell). In this connection, the second and third shell spaces are preferably connected to one another in a flow-guiding manner by a second shell space connecting means, in particular in the form of at least one pipeline. The three shells are preferably arranged coaxially to one another relative to their longitudinal axes (cylinder axes). To remove the first medium (e.g., liquid hydrocarbon-rich phase) from the heat exchanger system, the topmost third shell preferably has a first outlet at the upper end thereof. In addition, the heat exchanger system on the lowermost first shell has a first inlet for introducing the first medium (e.g., gaseous hydrocarbon-rich phase) into the first pipe space section of the first shell. For the case where the heat exchanger system is used for liquefying a hydrocarbon-rich gaseous phase (natural gas), the hydrocarbon-rich gaseous phase flows upward through the three first pipe space sections, connected to one another, of the three shells along the vertical, and in this way is pre-cooled, condensed, and subcooled by heat exchange with the second medium.

The above-mentioned (and also the additional) pipe space sections preferably extend along the longitudinal axis of the respective shell or along the vertical. The pipe space sections can be formed in particular by groups of pipes of a pipe bundle, in particular a wound pipe bundle, in which the individual pipes are wound around a central pipe, which extends along the longitudinal axis of the respective (optionally cylindrical) shell.

To pre-cool the first medium, the first shell is provided with a second pipe space section, surrounded by the first shell space, for accommodating the second medium. This second pipe space section of the first shell runs along the first pipe space section of the first shell, in such a way that the media flowing through these pipe space sections can enter into indirect heat exchange. To be able to introduce a liquid fraction of the second medium (refrigerant mixture) into that second pipe space section of the first shell, the lowermost first shell preferably has a second inlet. This second inlet can be connected to the bottom of a first separator, from which a liquid fraction of the refrigerant (second medium) can be removed. The second pipe space section of the first shell is now, preferably, connected to the upper end (relative to the vertical) of the first shell and thereby introduces (e.g., via a valve) the liquid fraction of the second medium (refrigerant) into the first shell space. This liquid fraction thus flows downward along the vertical or the longitudinal axis of the first shell, whereby the liquid fraction under goes indirect heat exchange with the first medium (natural gas) flowing through the first pipe space section of the first shell, e.g., the first medium flowing by cross current flow in the first shell (in a wound pipe bundle). In this respect, a pre-cooling of the hydrocarbon-rich phase that is to be liquefied (first medium) is produced.

In addition, the lowermost first shell can include a third pipe space section for accommodating a gaseous fraction of the second medium. This third pipe space section of the first shell runs along the first pipe space section of the first shell, in which the first medium flows, in such a way that an indirect heat exchange between the media flowing through these pipe space sections is possible. For admitting the gaseous fraction into the third pipe space section of the first shell, the first shell preferably has a third inlet on its lower end, which, for example, can be connected to the head of a second separator, from which a gaseous fraction of the refrigerant (second medium) can be removed.

In this case, the third pipe space section of the first shell is preferably connected, via a first outlet in the upper end of the first shell and a first inlet in the lower end of the second shell, to a second pipe space section of the second shell that is surrounded by the second shell. This second pipe space section of the second shell runs in particular along the first pipe space section of the second shell, through which the first medium flows upward, in such a way that an indirect heat exchange between the media flowing through these pipe space sections is possible.

Thus, in this arrangement the first outlet of the first shell can be connected, via a head of a third separator, to the first inlet of the second shell in such a way that a gaseous fraction of the second medium can be removed from that head of the separator and introduced into the second pipe space section of the second shell. In addition, the bottom of the third separator is preferably connected via a second inlet of the second shell to a third pipe space section of the second shell, which is surrounded by the second shell. The third pipe space section runs along the first and second pipe space sections of the second shell, in such a way that an indirect heat exchange between the media that flowing through these pipe space sections is possible. This third pipe space section of the second shell is preferably connected, at an upper end (relative to the vertical Z) of the second shell, to the second shell space (in particular via a valve), in such a way that the liquid fraction (removed from the bottom of the third separator) of the second medium can be introduced into the second shell space and can flow downward therein. The first medium flows through the first pipe space section of the second shell, e.g., in cross current flow therein (in a wound pipe bundle). In the second shell, the first medium that is guided in the first pipe space section of the second shell can thus be further cooled and liquefied.

In addition, preferably the second pipe space section of the second shell is connected in a flow-guiding manner via a third pipe space section connecting means, in particular in the form of at least one pipeline, to a second pipe space section of the third shell and surrounded by the third shell. This second pipe space section of the third shell runs along the first pipe space section of the third shell. In particular, the second pipe space section of the third shell is connected, at an upper end (relative to the vertical) of the third shell, to the third shell space (in particular via a valve), to thereby introduce the second medium in the form of a gaseous fraction of a refrigerant into the third shell space and thereupon flows downward along the vertical. In this topmost third shell, a subcooling of the first medium flowing through the first pipe space section of the third shell (e.g., in the corresponding current flow) is thus produced.

To remove the second medium from the bottom of the first shell, a second outlet is finally preferably provided on a lower end of the first shell. This second outlet of the first shell can be connected, in particular, to a two-stage compressor for compressing the second medium, whereby, in particular, the above-mentioned first and second separators are connected, via one additional heat exchanger, to each to the compressor.

In principle, it is, of course, also possible in a number of, e.g., three separate shells to consolidate two adjacent shells. Thus, for example, the first shell can form a uniform shell with the second or the second shell can form a uniform shell with the third shell, in such a way that only two separate shells are present. The corresponding shell space connection is then present based on the uniform shell space; the pipe space section connecting means then run correspondingly within this shell space as connections of the pipe room sections, which can be designed integrally with the pipe space sections.

In another embodiment of the invention, four separate shells are provided, whereby, e.g., the fourth shell can be formed by a subdividing the first shell into an upper first shell and a lower first shell (e.g., to provide a first pre-cooler and a subsequent second pre-cooler). In this connection, e.g., the lower first shell can have the outlets and/or inlets that are provided on the lower end of the first shell and the upper first shell can have the outlets and/or inlets that are provided on the upper end of the first shell. The lower first shell can have a shell-side inlet flow, like the other shells, e.g., in the form of a pipe space section that is run at an upper end in the lower first shell, in such a way that the second medium, guided therein, can be introduced into the lower first shell space.

Also, these first two shells are preferably arranged along the vertical at some distance from one another or above one another. Here, it is, of course, possible to restructure the naming of the individual shells in such a way that, for example, the lowermost shell is always the first shell and the other (three) shells are continuously numbered consecutively upward.

The lower first shell preferably surrounds a lower first shell space, which for its part surrounds a lower section of the related first pipe space section. This lower section of the first pipe space section is, in particular, connected via a third outlet, formed on an upper end of the lower first shell, to a fourth separator. A gaseous fraction of the first medium can be removed from the head of the fourth separator and introduced via a fourth inlet of the upper first shell into an upper section of the related first pipe space section, which is surrounded by an upper first shell space defined by the upper first shell.

In addition, the upper and lower first shell spaces are preferably connected in a flow-guiding manner to one another via a third shell space connecting means, in particular in the form of at least one pipeline. In addition, preferably, a lower section of the related second pipe space section, surrounded by the lower first shell space, is connected in a flow-guiding manner to an upper section of the related second pipe space section, surrounded by the upper first shell space, via a fourth pipe space section connecting means, particular in the form of at least one pipeline. Finally, in this embodiment, preferably a lower section of the related third pipe space section, surrounded by the lower first shell space, is connected in a flow-guiding manner to an upper section of the related third pipe space section, surrounded by the upper first shell space, via a fifth pipe space section connecting means, particular in the form of at least one pipeline.

To support the individual shell, preferably a frame, in particular in the form of a steel frame, is provided, on which the shells are in each case suspended separately.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein:

FIG. 1 shows a diagrammatic sectional view of a heat exchanger system 1 according to the invention. The latter has three separate shells 301, 303, 305, arranged above one another, which in each case enclose a related shell space 201, 203, 205. The three shells 301, 303, 305 are essentially designed as hollow cylinders and accordingly have a longitudinal axis (cylinder axis) that runs parallel to the vertical Z (relative to a state of the heat exchanger system 1 that is arranged as shown). In addition, shells 301, 303, 305 have a circumferential wall as well as a cover and a base. The cover and the base face one another along the vertical Z and seal off the respective shell upward and downward, respectively.

Figure 1:
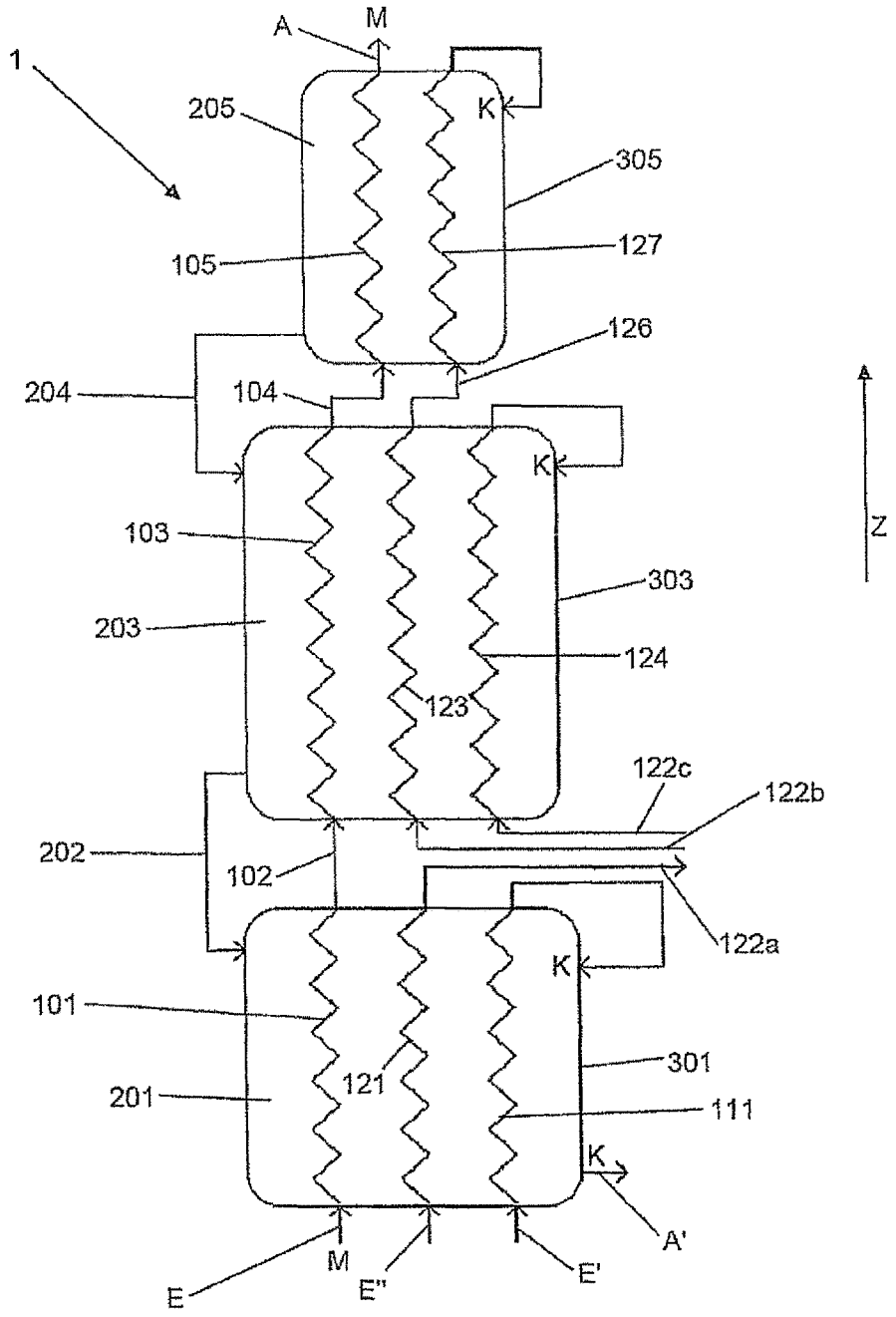
FIG. 1 shows a diagrammatic sectional view of a heat exchanger system according to the invention for liquefying a hydrocarbon-rich phase.

In each of the individual shells 301, 303, 305, or shell spaces 201, 203, 205, a wound pipe bundle is arranged, which in each case has a large number of pipes, which are wound around a central pipe.

In the lowermost first shell 301 just as in the central second shell 303, the pipe or tube bundles form a first pipe space section (101,103), a second pipe space section (121, 123), and a third pipe space section (111, 124). In the topmost third shell 305, the pipe bundle forms a first pipe space section 105 and a second pipe space section 127. In this connection, the individual pipe space sections 101, 121, 111 and/or 103, 123, 124 and/or 105, 127 can be formed by groups of pipes of the respective pipe bundle.

The first pipe space sections 101, 103, and 105 of the first, second and third shells 301, 303, 305 are used for accommodating a first medium M, which is preferably a hydrocarbon-rich phase that is to be liquefied. The first medium M is introduced into the heat exchanger system 1 via a first inlet E in the lower part (base) of the first shell 301 and flows upward along the vertical Z. Here, the space between the shells 301 and 303, and the space between shells 303 and 305 are bridged by first and second pipe space section connecting means 102, 104, respectively, in the form of pipelines. As a result, a pipe space passage is formed that extends along the vertical Z through the three separate shells 301, 303, 305.

When flowing through this pipe space passage, the first medium M is cooled in several steps in the area of the first shell 301, liquefied in the area of the second shell 303, and subcooled in the area of the third shell 305. The liquefied phase M can then be removed from the heat exchanger system 1 via a first outlet A from the upper part of the third shell 305 (e.g., from the cover of the third shell).

Figure 6:
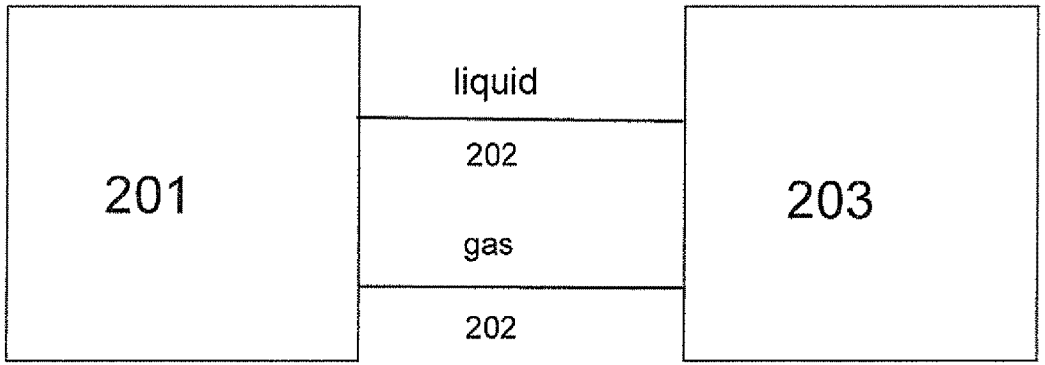
FIG. 6 is a flowchart illustrating the shell space connecting means providing separate flow of gas and liquid fractions between the first and second shell spaces.
Figure 7:
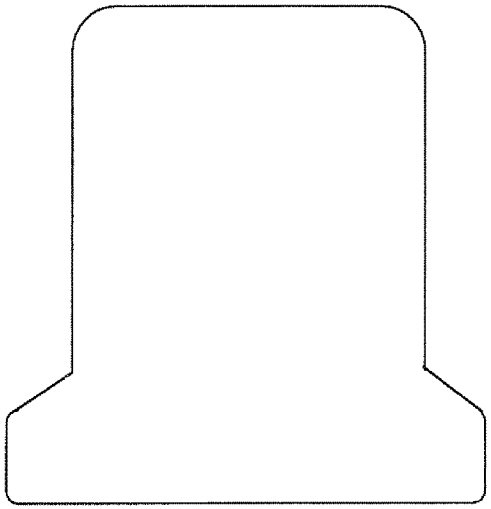
FIG. 7 shows a shells having an expanded lower region.
Figure 8:
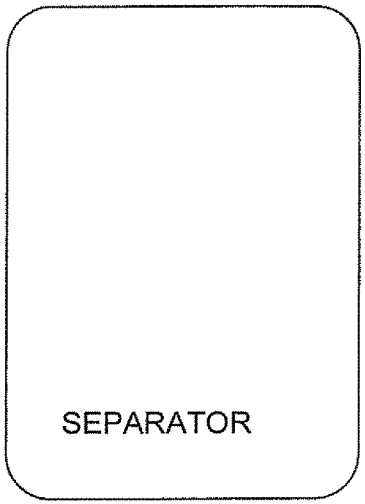
FIG. 8 show a shell having an a separator.

In the additional pipe space sections 121, 111 or 123, 124 or 127, the second medium K (refrigerant mixture) flows upward along the vertical Z and, in each case, at least a portion of the second medium K is introduced at the upper end of each shell into the respective shell space 201, 203, 205. In this manner, a portion of the second medium K can flow downward in each of the shell spaces 201, 203, 205 along the vertical Z. To achieve this downward flow through the shell spaces, the separate shells 301, 303, 305 are connected to one another by shell space connecting means. As shown in the Figures, shell spaces 201 and 203 (of shells 301 and 303) are connected via a first shell space connecting means 202 (see FIG. 6), in the form of a pipeline, and shell spaces 203 and 205 (of shells 303 and 305) are connected via a second shell space connecting means 204, in the form of a pipeline.

Figure 3:
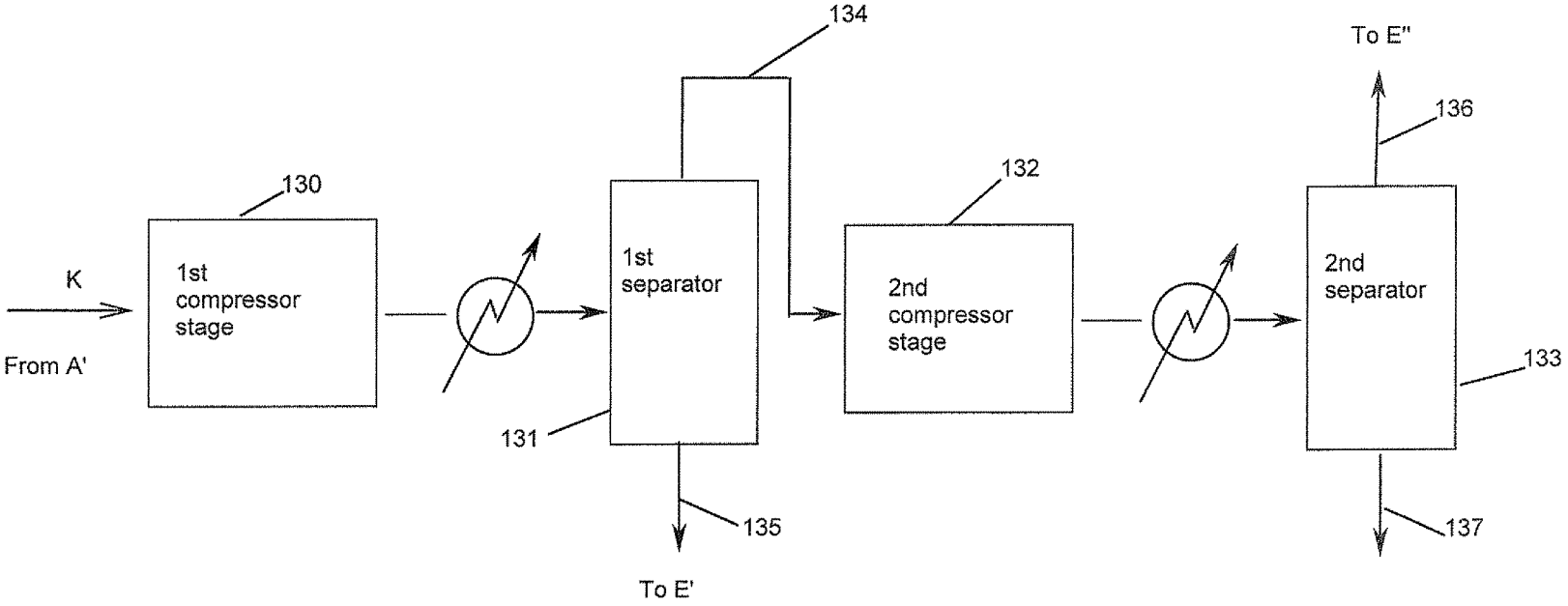
FIG. 3 shows a flow chart illustrating the compression of the second medium K in first and second compression stages with separator after each compression stage.

To liquefy the first medium M, in each of the the shell spaces 201, 203, 205 the first medium M and a portion of the second medium K flow upward in the cross current flow to a portion of the second medium K that flows downward through shell spaces 201, 203, 205. The cold end of the heat exchanger system 1 thus is found at the upper end (third shell 305). The second medium K can be removed from the bottom of the first shell 301 via a second outlet A' of the first shell 301 and can be separated into liquid and gaseous fractions to be able to feed the latter individually to the heat exchanger system 1. To this end, the second medium K that is removed from the bottom of the first shell 301 can be fed to a compressor (see FIG. 3). The compressor can have two compression stages. The second medium K (refrigerant mixture) that is compressed in the first compression stage 311 can be partially condensed in a secondary condenser or heat exchanger 312 against ambient air or water and fed to a first separator 313. In this first separator 313, the second medium K is separated into a gaseous fraction and a liquid fraction. The gaseous fraction is fed to the second compressor stage 316 and compressed in the latter to the desired final pressure. Also, downstream from the second compression stage 316, there is provided a further secondary condenser or heat exchanger 317, in which the compressed second medium K is preferably cooled against ambient air or water. The cooled and compressed second medium K is then fed to a second separator 314 wherein the cooled and compressed second medium K is separated into a further gaseous fraction and a further liquid fraction.

From the bottom of the first separator 313, the liquid fraction of the second medium K, is removed and then introduced, via a second inlet E' at the lower end of the first shell 301, into the second pipe space section 111 of the first shell 301. The liquid fraction of the second medium K flows upward along the vertical Z through the second pipe space section 111. Thereafter, the liquid fraction of the second medium K is introduced, under expansion (e.g., via an expansion valve) into the upper end of the first shell space 201 within the first shell 301. In this way, the liquid fraction of the first medium K can flow downward through the first shell space 201 and enter into indirect heat exchange with the first medium M, flowing upward through the first pipe space section 101 (as well as with the second medium K flowing upward through the third pipe space section 121 of the first shell 301). In addition, by a third inlet E" at the lower end of the first shell 301, the gaseous fraction (removed from the head of the second separator 314) of the second medium K is introduced into the third pipe space section 121 of the first shell 301 wherein it flows upward along the vertical Z. Thus, as a result, a pre-cooling of the first medium M can be performed in the first shell 301.

Figure 4:
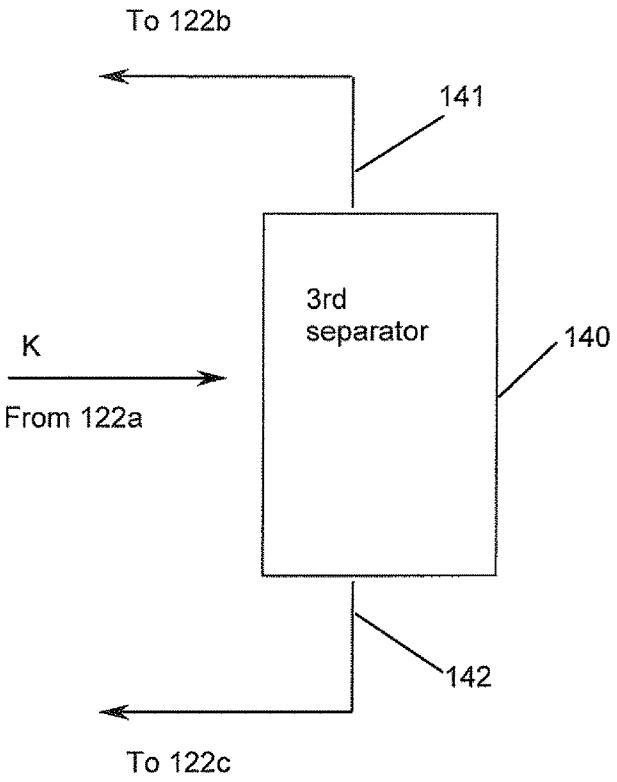
FIG. 4 is a flow chart illustrating the second medium being fed to a third separator and the removal of a gaseous fraction and a liquid fraction from the third separator.

The second medium K that flows upward through the third pipe space section 121 is withdrawn from the first shell 301, via a first outlet 122*a* at the upper end of the first shell 301, and then separated into liquid and gaseous fractions. To this end, the second medium K can be fed via the first outlet 122*a* to a third separator (see FIG. 4). A gaseous fraction of the second medium K, removed from the head of the third separator 315, is then introduced, via a first inlet 122*b* at the lower end of the second shell 303, into the second pipe space section 123 of the second shell 303. The liquid fraction of the second medium K, removed from the bottom of the third separator 315, is introduced via a second inlet 122*c* at the lower end of the second shell 303 into the third pipe space section 124 of the second shell 303. The liquid fraction of the second medium K flows upward through third pipe space section 124 and is then introduced, under expansion (e.g., via an expansion valve) into the upper end of the second shell 303 and into the second shell space 203. As a result, the liquid fraction of the second medium K can flow downward along the vertical Z through the second jacet space 203, through first shell space connecting means 202, and into the first shell 301. The liquid fraction of the second medium K thereby enters in particular into indirect heat exchange with the first medium M flowing upward through the first pipe space section 103 of the second shell 303 (and with the gaseous second medium K flowing upward through the second pipe space section 123 of the second shell 303). In addition, the gaseous fraction of the second medium K flows upward through the second pipe space section 123, through a third pipe space section connecting means 126, in the form of a pipeline, and into the second pipe space section 127 of the topmost third shell 305. As a result, an additional cooling/liquefying of the first medium M can be achieved in the second shell 303. Additionally, the first shell shell space connecting means 202 can include means (e.g., in the form of a pipeline, 202*a*) for introducing a gaseous fraction of the second medium K, separately from a means (pipeline 202*b*) for introducing a liquid fraction of the second medium, from the second shell space into the first shell space. In this regard, the second shell (303) can be provided with an expanded region 320 and/or a separating system 310 in a lower section thereof for separating second medium (K) that is to flow into the first shell space (201) into a liquid fraction of second medium (K) and a gaseous fraction of second medium (K).

Finally, in the third shell 305, a subcooling of the first medium M is performed. The gaseous fraction of the second medium K flows upward through the second pipe space section 127 of the third shell 305 and is then introduced, under expansion (e.g., via an expansion valve) into the upper end of the third shell 305 and into the third shell space 205. This gaseous fraction of the second medium K then flows downward along the vertical Z through the third shell space 205. In this connection, the second medium K enters into indirect heat exchange with the first medium M, flowing upward through the first pipe space section 105 of the third shell 305, whereby a subcooling of the liquefied first medium M is achieved.

In principle, it is, of course, also possible to consolidate adjacent shells 301, 303, or 303, 305. Thus, for example, the first shell can form a uniform shell with the second, or the second shell can form a uniform shell with the third shell (301 and 303, or 303 and 305), in such a way that only two separate shells are present.

Figure 2:
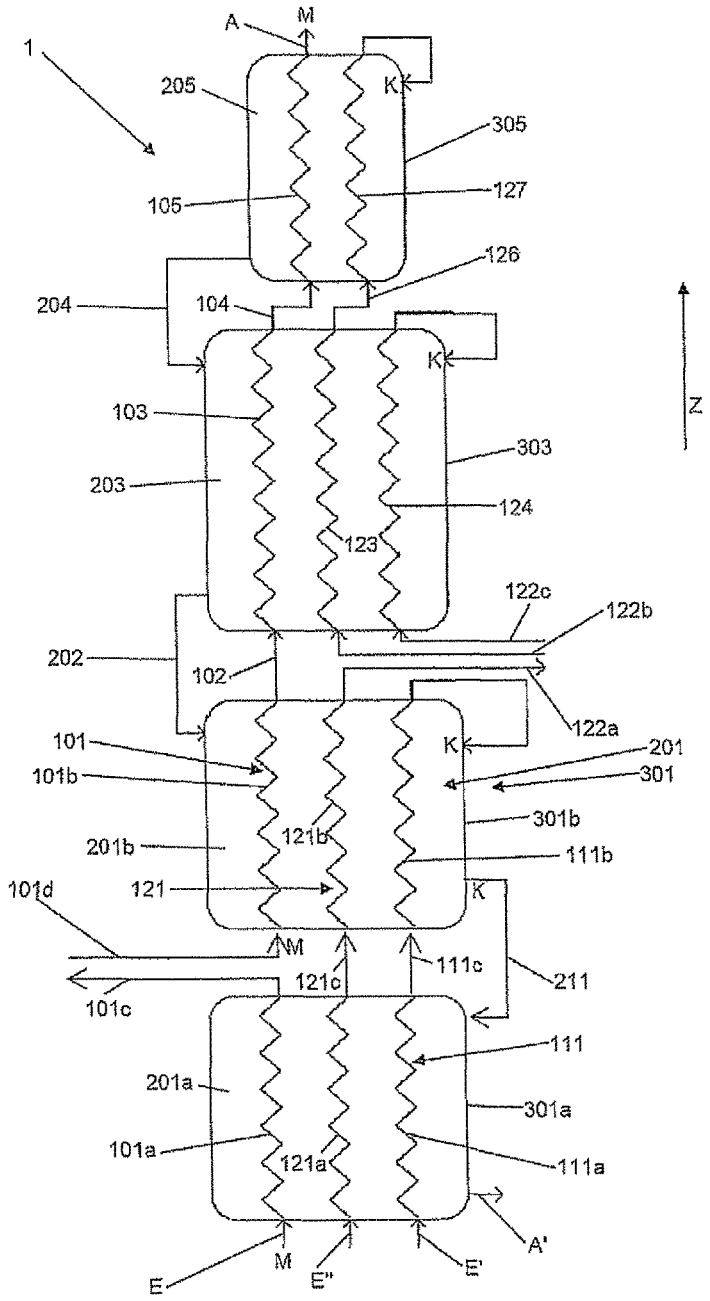
FIG. 2 shows a diagrammatic sectional view of another heat exchanger system according to the invention for liquefying a hydrocarbon-rich phase.

FIG. 2 shows another embodiment, in which unlike in FIG. 1, the first shell 301 is divided into two separate shells, which are arranged at some distance from one another along the vertical Z, namely an upper first shell 301*b* and a lower first shell 301*a*. As a result, the heat exchanger system 1 includes a total of four separate shells 301*a*, 301*b*, 303, 305. By this division, the pre-cooler that comprises the first shell 301 according to FIG. 1 is divided into first and second pre-coolers. The first medium M is removed between the lower first shell 301*a* and the upper first shell 301*b* to separate and remove heavy components of the first medium M (natural gas) and to then supply the resulting gas phase to the second pre-cooler (upper first shell 301*b*). The two first shells 301*a*, 301*b* correspondingly form separate a lower first shell space 201*a* and a separate upper first shell space 201*b*, and these shell spaces are connected to one another in a flow-guiding manner via a third shell space connecting means 211, in the form of a pipeline.

Figure 5:
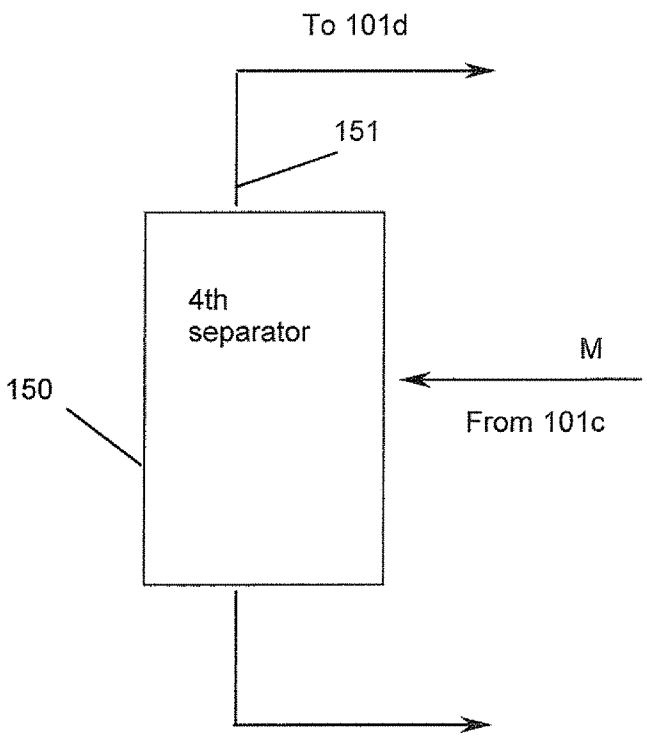
FIG. 5 is a flow chart the first medium being fed to a fourth separator and the removal of a gaseous fraction and from the fourth separator.

To separate the heavy components, the first medium M is introduced via a first inlet E of the lower first shell 301*a* into a lower section 101*a* of the first pipe space section 101, that lower section 101*a* of the first pipe space section 101. The first medium M is then removed from the lower section 101*a* of the first pipe space section 101 via a third outlet 101*c* at the upper end of the lower first shell 301*a*, and fed to a fourth separator 318. The gaseous fraction of the first medium M is removed from the head of the fourth separator (see FIG. 5), and is introduced via a fourth inlet 101*d* into the lower end of the upper first shell 301*b* and into an upper section 101*b* of the first pipe space section 101. The upper section 101*b* is surrounded by the upper first shell space 201*b*.

The second medium K is introduced via the second and third inlets E', E", now at the lower end of the lower first shell 301*a*, into the lower sections 111*a*, 121*a*, respectively, of the third and second pipe space section 111, 121 respectively. The second medium K is introduced into lower sections 121*a* in the form of a gaseous fraction and into lower sections 111*a* in the form of a liquid fraction. The flows of second medium K from lower sections 111*a*, 121*a* are introduced, respectively, into the upper sections 111*b*, 121*b*, surrounded by the upper first shell 301*b* (shell space 201*b*), via a fourth pipe space section connecting means 111*c* and fifth pipe space section connecting means 121*c*, in the form of a pipelines, respectively. The second outlet A' is now positioned at lower end (bottom) of the lower first shell 301*a*.

The entire disclosure[s] of all applications, patents and publications, cited herein and of corresponding German Application No. 10 2011 015 433.7, filed Mar. 29, 2011, are incorporated by reference herein.

The preceding examples can be repeated with similar success by substituting the generically or specifically described reactants and/or operating conditions of this invention for those used in the preceding examples.

List of Reference Symbols

| | |
|---|---|
| 1 | Heat Exchanger System |
| 101 | First Pipe Space Section |
| 102 | First Pipe Space Section Connecting Means |
| 103 | First Pipe Space Section |
| 104 | Second Pipe Space Section Connecting Means |
| 105 | First Pipe Space Section |
| 111 | Second Pipe Space Section |
| 121 | Third Pipe Space Section |
| 122a | First Outlet |
| 122b | First Inlet |
| 122c | Second Inlet |
| 123 | Second Pipe Space Section |
| 124 | Third Pipe Space Section |
| 126 | Third Pipe Space Section Connecting Means |

-continued

| List of Reference Symbols | |
|---|---|
| 127 | Second Pipe Space Section |
| 201 | First Shell Space |
| 202 | First Shell Space Connecting Means |
| 203 | Second Shell Space |
| 204 | Second Shell Space Connecting Means |
| 205 | Third Shell Space |
| 301 | First Shell |
| 303 | Second Shell |
| 305 | Third Shell |
| 201a | Lower First Shell Space |
| 201b | Upper First Shell Space |
| 301a | Lower First Shell |
| 301b | Upper First Shell |
| 101a | Lower Section |
| 101b | Upper Section |
| 111a | Lower Section |
| 111b | Upper Section |
| 121a | Lower Section |
| 121b | Upper Section |
| 111c | Fourth Pipe Space Section Connecting Means |
| 121c | Fifth Pipe Space Section Connecting Means |
| 211 | Third Shell Space Connecting Means |
| 101c | Third Outlet |
| 101d | Fourth Inlet |
| A | First Outlet |
| A' | Second Outlet |
| E | First Inlet |
| E' | Second Inlet |
| E" | Third Inlet |
| M | First Medium |
| K | Second Medium |
| Z | Vertical |

The invention claimed is:

1. A heat exchanger system (1) for heat exchange between at least a first medium (M), and a second medium (K), said system comprising:

at least two first pipe space sections (101, 103; 103, 105) for accommodating the first medium (M), and a first pipe space section connecting means (102; 104), via which the two first pipe space sections (101, 103; 103, 105) are connected to one another in a flow-guiding manner, wherein said first pipe space section connecting means is in the form of at least one pipeline;

wherein one of said two first pipe space sections (101; 103) is surrounded by a first shell space (201, 203) for accommodating the second medium (K), and the other of said two first pipe space section (103; 105) is surrounded by a second shell space (203, 205) for accommodating the second medium (K), wherein each of said first shell space (201, 203) and said second shell space (203, 205) has a longitudinal axis, wherein said one of said two first pipe space sections is in the form of a wound pipe bundle in which individual pipes are wound around a central pipe extending along the longitudinal axis of said first shell space, and said other of said first two pipe space sections is in the form of a wound pipe bundle in which individual pipes are wound around a central pipe extending along the longitudinal axis of said second shell space, wherein said first shell space (201; 203) is defined by a first shell (301; 303) and said second shell space (203; 205) is defined by a second shell (303; 305), and said first shell space and said second shell space are separate from one another, wherein said second shell (303; 305) is arranged in the vertical direction (Z) a distance above said first shell (301; 303), and said first and second shell spaces (201, 203; 203, 205) are connected to one another in a flow-guiding manner by a first shell space connecting means (202; 204), wherein said second shell (303) has a means for separating the second medium (K) flowing through said second shell space (203) into a liquid fraction of the second medium (K) and a gaseous fraction of the second medium (K), and said means for separating is (a) an expanded region in a lower section of said second shell space (203), or (b) a separator arranged below said wound pipe bundle in said second shell space, wherein said first shell space connecting means (202; 204) is in the form of pipelines, said first shell space connecting means provides for transport of the gaseous fraction of second medium (K) and transport of the liquid fraction of second medium (K) from a lower section of said second shell space (203, 205) to an upper section of said first shell space (201, 203), wherein the gaseous fraction of second medium (K) is transported separately from the liquid fraction of second medium (K) via said first shell space connecting means.

2. The heat exchanger system according to claim 1, wherein said first shell (301) provides heat exchange for pre-cooling of the first medium (M) in said one of said two first pipe space section (101) within said first shell (301), and wherein said second shell (303) provides heat exchange for liquefying the first medium (M) in said other of said two first pipe space section (103) within said second shell (303).

3. The heat exchanger system according to claim 1, wherein said first shell (303) provides heat exchange for liquefying the first medium (M) that is guided in said one of said two first pipe space section within said first shell (303), and said second shell (305) provides heat exchange for subcooling first medium (M) that is guided in said other of said two first pipe space section (105) within said second shell (305), said first shell (303) further comprises a second pipe space section (123), which is surrounded by said first shell space (203), wherein a gaseous fraction of second medium (K) can be introduced into said second pipe space section (123) of said first shell (303) via a first inlet (122*b*) of said first shell (303), and said second pipe space section (123) within said first shell (303) runs along said first pipe space section (103) within said first shell (303), said first shell (303) further comprises a third pipe space section (124), which is surrounded by said first shell space (203), wherein a liquid fraction of second medium (K) can be introduced into said third pipe space section (124) via a second inlet (122*c*) of said first shell (303), and said third pipe space section (124) within said first shell (303) runs along said first pipe space section (103) within said first shell (303), said third pipe space section (124) of said first shell (303) is connected at the upper end of said first shell (303) to introduce the liquid fraction of second medium (K) into said first shell space (203), said second pipe space section (123) within said first shell (303) is connected in a flow-guiding manner via a second pipe space section connecting means (126), in the form of at least one pipeline, to a second pipe space section (127) within said second shell space (205) surrounded by said second shell (305), said second pipe space section (127) within said second shell (305) runs along said first pipe space section (105) within said second shell (305), and said second pipe space section (127) within said second shell (305) is connected at the upper end of said second shell (305) to introduce a gaseous fraction of second medium (K) into said second shell space (205), and said first shell (303) has an expanded region (320).

4. The heat exchanger system according to claim 1, wherein said second shell (303) has an expanded region in a lower section thereof.

5. The heat exchanger system according to claim 1, further comprising a separate third shell (305), said third shell (305) having therein a further first pipe space section (105) for accommodating flow of the first medium (M), said further first pipe space section (105) of said third shell (305) being connected in a flow-guiding manner to said first pipe space section (103) of said second shell (303) via a second pipe space section connecting means (104) in the form of at least one pipeline, said one of said two first pipe space section (105) within said third shell (305) is surrounded by a related third shell space (205) for accommodating second medium (K), wherein said third shell (305) provides heat exchange for subcooling the first medium (M), and said third shell (305) is arranged at some distance from said first shell and/or second shell (301, 303), whereby said third shell (305) is arranged along the vertical (Z) above said second shell (303), and said second and third shell spaces (203, 205) are connected to one another in a flow-guiding manner by a second shell space connecting means (204), in particular in the form of at least one pipeline, and said third shell (305) has a first outlet (A) for removing the first medium (M) from the heat exchanger system (1) in the form of a liquid phase.

6. The heat exchanger system according to claim 1, wherein said first shell (301) has a first inlet (E) for admitting the first medium (M), in the form of a gaseous phase, into said first pipe space section (101) within said first shell (301).

7. The heat exchanger system according to claim 1, wherein said first shell (301) further comprises therein a second pipe space section for accommodating second medium (K) in the form of a liquid fraction, said second pipe space section within said first shell (301) runs along said first pipe space section (101) within said first shell (301), and said first shell (301) has a second inlet (E') for admitting the liquid fraction of second medium (K) into said second pipe space section within said first shell (301), said second inlet (E') is connected to the bottom of a first separator (313), from which the liquid fraction of second medium (K) can be removed, and said second pipe space section within said first shell (301) is connected to the upper end of said first shell (301) to introduce the liquid fraction of second medium (K) into said first shell space (201).

8. The heat exchanger system according to claim 1, wherein said first shell (301) further comprises therein a third pipe space section for accommodating second medium (K) in the form of a gaseous fraction, said third pipe space section within said first shell (301) runs along said first pipe space section (101) within said first shell (301), and said first shell (301) has a third inlet (E") for admitting the gaseous fraction of second medium (K) into said third pipe space section within said first shell (301), and said third inlet (E') is connected to a head of a second separator (314) from which the gaseous fraction of second medium (K) can be removed.

9. The heat exchanger system according to claim 8, wherein said third pipe space section within said first shell (301) is connected, via a first outlet (122*a*) of said first shell (301) and a first inlet (122*b*) of said second shell (303), to a second pipe space section (123) within said second shell (303) that is surrounded by said second shell (303), whereby said second pipe space section (123) within said second shell (303) runs along said first pipe space section (103) within said second shell (303), said first outlet (122*a*) of said first shell (301) is connected via the head of a third separator (315) to said first inlet (122*b*) of said second shell (303), whereby a gaseous fraction of second medium (K) can be removed from said head of said third separator (315), and the bottom of said third separator is connected via a second inlet (122*c*) of said second shell (303) to a third pipe space section (124) within said second shell (303), which is surrounded by said second shell (303), said third pipe space section (124) within said second shell (303) runs along said first pipe space section (103) within said second shell (303), and said third pipe space section (124) of said second shell (303) is connected to an upper end of said second shell (303) to introduce a liquid fraction of second medium (K) into said second shell space (203).

10. The heat exchanger system according to claim 9, further comprising a separate third shell (305), said third shell (305) having therein a further first pipe space section (105) for accommodating flow of the first medium (M), said first pipe space section (105) of said third shell (305) being connected in a flow-guiding manner to said first pipe space section (103) of said second shell (303) via a second pipe space section connecting means (104), in particular in the form of at least one pipeline, said first pipe space section (105) within said third shell (305) is surrounded by a related third shell space (205) for accommodating second medium (K), wherein said third shell (305) is designed for subcooling the first medium (M), and said third shell (305) is arranged at some distance from said first shell and/or second shell (301, 303), whereby said third shell (305) is arranged along the vertical (Z) above said second shell (303), and said second and third shell spaces (203, 205) are connected to one another in a flow-guiding manner by a second shell space connecting means (204), in particular in the form of at least one pipeline, and said third shell (305) has a first outlet (A) for removing the first medium (M) from the heat exchanger system (1) in the form of a liquid phase, wherein said second pipe space section (123) within said second shell (303) is connected in a flow-guiding manner, via a third pipe space section connecting means (126), in particular in the form of at least one pipeline, to a second pipe space section (127) within said third shell (305), said second pipe space section (127) being surrounded by said third shell (305), wherein said second pipe space section (127) within said third shell (305) runs along said first pipe space section (105) within said third shell (305), and said second pipe space section (127) within said third shell (305) is connected at an upper end of said third shell (305) to introduce a gaseous fraction of second medium (K) into said third shell space (205).

11. The heat exchanger system according to claim 1, wherein said first shell (301) further comprises therein a second pipe space section for accommodating second medium (K) in the form of a liquid fraction, said second pipe space section within said first shell (301) runs along said first pipe space section (101) within said first shell (301), and said first shell (301) has a second inlet (E') for admitting the liquid fraction of second medium (K) into said second pipe space section within said first shell (301), said second inlet (E') is connected to the bottom of a first separator, from which the liquid fraction of second medium (K) can be removed, and said second pipe space section within said first shell (301) is connected to the upper end of said first shell (301) to introduce the liquid fraction of second medium (K) into said first shell space (201), wherein said first shell (301) further comprises therein a third pipe space section for accommodating second medium (K) in the form of a gaseous fraction, said third pipe space section within said first shell (301) runs along said first pipe space section (101) within said first shell (301), and said first shell (301) has a third inlet (E") for admitting the gaseous fraction of second medium (K) into said third pipe space section within said first shell (301), and said third inlet (E') is connected to a head of a second separator from which the gaseous fraction of second medium (K) can be removed, wherein said first shell (301) is provided with a second outlet (A') for removing second medium (K) from the bottom of said first shell (301), wherein said second outlet (A') of said first shell (301) is connected to a two-stage compressor (311, 316) for compressing second medium (K), wherein said first (313) and second (314) separators are connected via one heat exchanger (312, 317) each to the compressor (311, 316).

12. The heat exchanger system according to claim 1, wherein said first shell (301) is divided into a separate upper first shell (301*b*) and a separate lower first shell (301*a*), wherein said upper first shell (301*b*) defines an upper first shell space (201*b*) and said lower first shell (301*a*) defines a lower first shell space (201*a*), wherein said upper first shell (301*b*) and said lower first shell (301*a*) are arranged at some distance from one another along the vertical (Z), and said upper first shell space and said lower first shell space (201*b*, 201*a*) are connected to one another in a flow-guiding manner via a third shell space connecting means (211), in particular in the form of at least one pipeline.

13. The heat exchange system according to claim 12, wherein said lower first shell space (201*a*) surrounds a lower section (101*a*) of said first pipe space section (101), and said lower section (101*a*) of said first pipe space section (101) is connected via a third outlet (101*c*), at an upper end of said lower first shell (101*a*), to a fourth separator, wherein a gaseous fraction of the first medium (M) can be removed from the head of said fourth separator and introduced via a fourth inlet (101*d*) of said upper first shell (301*b*) into an upper section (101*b*) of said first pipe space section (101), which is surrounded by said upper first shell space (201*b*), wherein a lower section (111*a*) of said second pipe space section (111) is surrounded by said lower first shell space (201*a*), and is connected in a flow-guiding manner to an upper section (111*b*) of said second pipe space section (111), surrounded by said upper first shell space (201*b*), via a fourth pipe space section connecting means (111*c*), and wherein a lower section (121*a*) of said third pipe space section (121) is surrounded by said lower first shell space (201*a*), and is connected in a flow-guiding manner to an upper section (121*b*) of said third pipe space section (121), which is surrounded by said upper first shell space (201*b*), via a fifth pipe space section connecting means (121*c*).

14. The heat exchanger system according to claim 1, wherein the first medium (M) is a hydrocarbon-rich phase.

* * * * *